US007036750B2

(12) United States Patent
Krumma et al.

(10) Patent No.: US 7,036,750 B2
(45) Date of Patent: May 2, 2006

(54) AXIAL SHAPING AIR DESIGN FOR PAINT ATOMIZER

(75) Inventors: Harry Krumma, Bönnigheim (DE); Michael Baumann, Flein (DE)

(73) Assignee: Dürr Systems, Inc., Auburn Hills, MI (US)

( * ) Notice: Subject to any disclaimer, the term of this patent is extended or adjusted under 35 U.S.C. 154(b) by 172 days.

(21) Appl. No.: 10/624,586

(22) Filed: Jul. 22, 2003

(65) Prior Publication Data

US 2004/0129799 A1 Jul. 8, 2004

(30) Foreign Application Priority Data

Jul. 22, 2002 (DE) ..... 102 33 198

(51) Int. Cl.
*B05B 1/28* (2006.01)
*B05B 1/34* (2006.01)
*B05B 7/10* (2006.01)

(52) U.S. Cl. ..... 239/296; 239/290; 239/291; 239/292; 239/293; 239/406; 239/380

(58) Field of Classification Search ..... 239/290–301, 239/398, 406, 381, 380, 418, 451, 457
See application file for complete search history.

(56) References Cited

U.S. PATENT DOCUMENTS

| | | | | |
|---|---|---|---|---|
| 4,376,135 A | | 3/1983 | Patel et al. | 427/31 |
| 4,521,462 A | | 6/1985 | Smythe | 427/421 |
| 4,572,437 A | | 2/1986 | Huber et al. | 239/703 |
| 4,589,597 A | | 5/1986 | Robisch et al. | 239/703 |
| 4,684,064 A | | 8/1987 | Kwok | 239/223 |
| 4,715,314 A | | 12/1987 | Ramseier et al. | 118/631 |
| 4,852,810 A | | 8/1989 | Behr et al. | 239/703 |
| 4,887,770 A | * | 12/1989 | Wacker et al. | 239/703 |
| 4,919,333 A | | 4/1990 | Weinstein | 239/223 |
| 4,927,081 A | | 5/1990 | Kwok et al. | 239/223 |
| 4,944,459 A | | 7/1990 | Watanabe et al. | 239/305 |
| 4,955,960 A | | 9/1990 | Behr et al. | 239/3 |
| 5,011,086 A | | 4/1991 | Sonnleitner et al. | 239/691 |
| 5,078,321 A | | 1/1992 | Davis et al. | 239/224 |
| 5,127,125 A | | 7/1992 | Skibowski | 15/104.061 |
| 5,294,217 A | | 3/1994 | Talacko et al. | 406/91 |
| 5,300,006 A | | 4/1994 | Tanaka et al. | 483/56 |
| 5,397,063 A | | 3/1995 | Weinstein | 239/703 |
| 5,622,563 A | | 4/1997 | Howe et al. | 118/620 |
| 5,632,448 A | * | 5/1997 | Alexander et al. | 239/703 |
| 5,633,306 A | | 5/1997 | Howe et al. | 524/409 |
| 5,662,278 A | | 9/1997 | Howe et al. | 239/700 |
| 5,683,032 A | | 11/1997 | Braslaw et al. | 239/7 |
| 5,704,977 A | | 1/1998 | Baumann et al. | 118/323 |
| 5,865,380 A | | 2/1999 | Kazama et al. | 239/704 |

(Continued)

FOREIGN PATENT DOCUMENTS

DE 41 05 116 A 1 8/1992

(Continued)

*Primary Examiner*—Davis Hwu
(74) *Attorney, Agent, or Firm*—Howard & Howard

(57) ABSTRACT

Rotary atomizer for coating work pieces, with a rotating bell-shaped plate shaft for a bell-shaped plate for discharging a spray stream of a coating agent, at least one steering air outlet for discharging steering air for shaping the spray stream, a housing, and also at least one steering air line, which is arranged in the housing and which opens into the steering air outlet, for supplying the steering air. It is proposed that the steering air line pass through the bearing unit of the drive turbine in the axial direction.

25 Claims, 1 Drawing Sheet

U.S. PATENT DOCUMENTS

| | | | | |
|---|---|---|---|---|
| 6,037,010 | A | 3/2000 | Kahmann et al. | 427/421 |
| 6,090,450 | A | 7/2000 | Kahmann et al. | 427/421 |
| 6,508,610 | B1 | 1/2003 | Dietrich | 406/13 |
| 6,589,348 | B1 | 7/2003 | Ott | 118/684 |

FOREIGN PATENT DOCUMENTS

| | | | |
|---|---|---|---|
| DE | 43 42 128 | A1 | 6/1995 |
| DE | 196 10 588 | A 1 | 9/1997 |
| DE | 197 09 988 | A 1 | 10/1998 |
| DE | 197 42 588 | A1 | 4/1999 |
| DE | 198 30 029 | A 1 | 1/2000 |
| DE | 199 09 369 | A 1 | 9/2000 |
| DE | 199 37 425 | A 1 | 3/2001 |
| DE | 100 33 986 | A 1 | 1/2002 |
| DE | 100 63 234 | C 1 | 7/2002 |
| DE | 101 30 173 | A 1 | 1/2003 |
| DE | 102 02 712 | A1 | 7/2003 |
| EP | 0 767 005 | A1 | 4/1997 |
| EP | 0 904 848 | A1 | 3/1999 |
| EP | 0 967 016 | A1 | 12/1999 |
| EP | 1 108 475 | A2 | 6/2001 |
| EP | 1 114 677 | A1 | 7/2001 |
| EP | 1 172 152 | A1 | 1/2002 |
| WO | WO 94/22589 | | 10/1994 |

* cited by examiner

AXIAL SHAPING AIR DESIGN FOR PAINT ATOMIZER

PRIOR APPLICATIONS

This application claims priority to German Patent Application No. DE 102 33 198.7 file Jul. 22, 2002.

FIELD OF THE INVENTION

The invention concerns a rotary atomizer for coating work pieces according to the preamble of claim 1.

BACKGROUND

Painting systems use known rotary atomizers, which have a so-called bell-shaped plate that is driven by a compressed-air turbine at high rpm. The bell-shaped plate is usually shaped like a truncated cone and expands in the direction of spraying, with the coating agent to be applied being accelerated in the truncated cone-like bell-shaped plate due to centrifugal forces in the axial direction and particularly in the radial direction, so that a conical spray stream is produced at the stub edge of the bell-shaped plate.

Furthermore, to form the spray stream it is known to blow so-called steering air onto the outer surface of the bell-shaped plate, with the steering air influencing the direction of the paint particles sprayed at the stub edge of the bell-shaped plate. By controlling the amount and the speed of the blown steering air, the shape of the spray stream, and thus the spray stream width, can be adjusted.

It is further known from DE 102 02 712 to direct two steering air streams, which can be controlled separately from each other, onto the spray stream.

For the known rotary atomizers of the previously described type, the steering air is supplied by a steering air line, which runs within the housing of the rotary atomizer towards the outside, between the housing wall and the compressed air turbine. In contrast, the steering air line meets an inlet in the mounting-side end surface of the rotary atomizer, the position of which is predetermined by corresponding connections in the attachment flange of the associated coating machine, such as, e.g., a painting robot, and thus cannot be changed.

A first disadvantage of the previously described guidance of the steering air line within the rotary atomizer, towards the outside between the housing wall and the compressed air turbine, is the fact that the housing diameter of the rotary atomizer is increased by the required cross section of the steering air line, with the installation space available for the compressed air turbine being reduced by the steering air line.

Another disadvantage of the known arrangement of the steering air line is that the steering air line must be first redirected, starting from the connection in the mounting-side end surface, in order to be able to guide it past the compressed air turbine on the outside. This guidance of the steering air line is poor in terms of flow dynamics, however, because the flow resistance is increased by the changes in direction of the steering air and undesired resonance effects can also appear within the steering air line, which produce worse painting results.

The invention is therefore based on the problem of optimizing the known rotary atomizer, described in the introduction, with reference to the required installation space and in terms of the flow dynamics.

SUMMARY OF THE INVENTION

The problem is solved, starting from the known rotary atomizer described in the introduction, according to the preamble of claim 1, by the characterizing features of claim 1 and by a bearing unit with the features of claim 15.

The invention includes the general technical teaching of arranging the steering air line, not towards the outside between the housing wall of the rotary atomizer and the compressed air turbine, but instead further inside in the radial direction.

Preferably, the steering air line in this way passes axially, at least in part, through a bearing unit of the compressed air turbine, so that the steering air line does not have to be guided around the compressed air turbine on the outside in a complicated way. Therefore, the bearing unit of the compressed air turbine preferably has an axial through hole, which forms a part of the steering air line.

Usually, the compressed air turbine consists of two approximately cylindrical sections with different outer diameters, with the turbine wheel being arranged in the section with the larger outer diameter. Preferably, the steering air line runs axially through the section of the bearing unit with the greater outer diameter, and opens on the side toward the bell-shaped plate into a so-called air space, which surrounds on the outside the section of the bearing unit having a smaller outer diameter. From this so-called air space, the steering air is then guided through one or more holes arranged in the bearing unit to the steering air outlet, with this hole starting from an opening in the surface shell of the bearing unit and running to a hole in the end surface of the bearing unit on the bell-shaped plate side.

In one variant of the invention, this hole runs at an acute angle to the axis of rotation of the bell-shaped plate, and is essentially without bends.

In contrast, in another variant of the invention this hole in the bearing unit starts from the end surface of the bearing unit on the bell-shaped plate side, and first runs parallel to the axis of rotation of the bell-shaped plate and then opens into a needle hole that runs radially and that opens into the air space at the surface shell of the bearing unit.

Preferably, the steering air line runs essentially without bends at least over a large part of its length in order to optimize fluidic properties of the flow of the steering air.

In addition, the steering air line preferably has an essentially constant cross-sectional area at least over a large part of its length in order to achieve uniform flow of the steering air within the steering air line.

This is preferably assisted in that the steering air line has an essentially constant, and preferably obstacle-free, interior shape at least over a large part of its length.

In an advantageous refinement of the invention, preferably at least two steering air outlets are provided to form the spray stream, with the steering air outlets preferably being arranged at a different radial distance from the axis of rotation of the bell-shaped plate. The individual steering air outlets are preferably supplied with steering air by separate steering air lines, which provides a great amount of freedom in terms of the shape of the spray stream.

One of the steering air lines can be arranged in the conventional way, described in the introduction, towards the outside between the housing wall and the compressed air turbine, while another steering air line is arranged in the previously described way, according to the invention, farther inside at a distance from the housing wall.

Other advantageous refinements of the invention are characterized in the subordinate claims or are described in more detail in the following, together with the description of the preferred embodiment of the invention with reference to the drawing.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
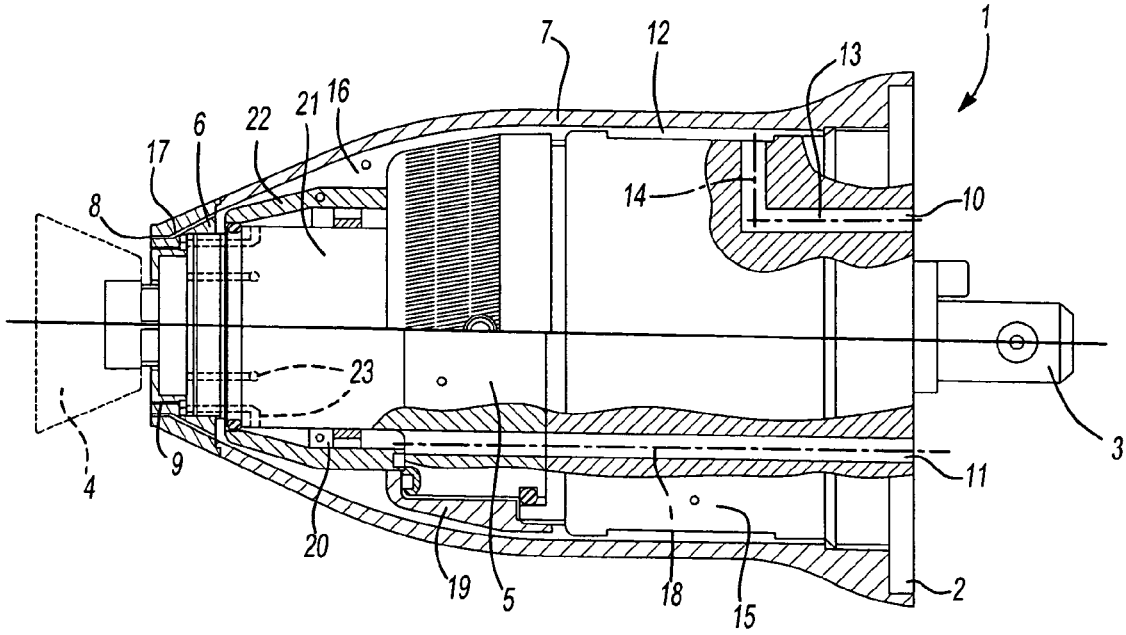
FIG. 1 shows a cross section of a rotary atomizer according to the invention.

The cross section reproduced in FIG. 1 shows a rotary atomizer 1 according to the invention, which is installed essentially conventionally, so that for information additional to the following description, refer to the cited prior art.

For assembling the rotary atomizer 1, this has on its mounting-side end surface an attachment flange 2 with an attachment pin 3, which enables mechanical attachment to a robot arm of a painting robot.

A conventional truncated cone-like, bell-shaped plate 4 can be formed on the rotary atomizer 1. This bell-shaped plate is illustrated here only with dashed lines, and is driven by a compressed air turbine 5 at high rpm during operation of the rotary atomizer 1. The rotation of the bell-shaped plate 4 leads to the condition that the coating agent introduced into the interior of the bell-shaped plate 4 is accelerated in the axial direction and especially in the radial direction, and is sprayed at a stub edge of the bell-shaped plate.

The drive of the compressed air turbine 5 is achieved by compressed air, which is guided from the painting robot via the attachment flange 2, with the supply of drive air not being illustrated here for simplification.

Furthermore, for shaping the spray stream discharged from the bell-shaped plate 4, a so-called steering air ring 6 is provided that is arranged in the end surface, on the bell-shaped plate side, of a housing 7 of the rotary atomizer 1. In the steering air ring 6, there are several steering air nozzles 8, 9 aligned in the axial direction, by means of which, during operation of the rotary atomizer 1, a steering air current can be blown in the axial direction towards the outside onto the conical surface shell of the bell-shaped plate 4. Depending on the amount and speed of the steering air blown from the steering air nozzles 8, 9, the spray stream is shaped and the desired stream width is set.

The supply of steering air for the two steering air nozzles 8, 9 is achieved via corresponding flange openings 10, 11 that are arranged in the attachment flange 2 of the rotary atomizer 1. The position of each flange opening 10, 11 within the end surface of the attachment flange 2 is given by the position of corresponding connections on the associated attachment flange of the painting robot.

The outer steering air nozzle 8 is supplied in the conventional way, described in the introduction, by a steering air line 12 that is guided along the outside of the compressed air turbine 5 between the housing 7 and the compressed air turbine 5. For this purpose, the flange opening 10 opens first into an axial needle hole 13, which then transitions into a radial needle hole 14, which finally opens at the outside of a valve housing 15 into an intermediate space between the housing 7 and the valve housing 15. The steering air is then led past the compressed air turbine 5 into a so-called air space 16, from where it is finally led through needle holes 17 in the steering air ring 6 to the steering air nozzle 8.

In contrast, the supply of steering air for steering air nozzle 9 is realized through a steering air line 18, which starts from the flange opening 11 in the attachment flange 2 in the axial direction and runs without bends through the valve housing 15. In addition, the steering air line 18 also runs in the axial direction through a bearing unit 19 of the compressed air turbine 5. The radial distance of the steering air line 18 from the axis of rotation of the bell-shaped plate 4 is greater than the outer diameter of the turbine wheel, which is not shown for simplification, so that the steering air line 18 runs on the outside of the turbine wheel. On the bell-shaped plate side, the steering wheel line 18 then opens into another air space 20 that is arranged between an essentially cylindrical section 21 of the compressed air turbine 5 and a cover 22 surrounding this section.

In the surface shell of the section 21 are several holes 23 that open into the end surface, on the bell-shaped plate side, of the compressed air turbine, and finally into the steering air nozzles 9. The holes 23 in the section 21 of the compressed air turbine 5 consist of a radial needle hole starting from the surface shell of the section 21 and an axial needle hole starting from the end surface on the bell-shaped plate side of section 21, which enables simple assembly.

One advantage of the previously described arrangement of the additional steering air line 18 is the fact that the diameter of the housing 7 of the rotary atomizer 1 is not enlarged by the additional steering air line 18, and also the construction space available for the compressed air turbine 5 is not reduced by the steering air line 18.

Another advantage of the steering air line 18 according to the invention can be seen in the bend-free guidance of the steering air current, which is optimized in terms of flow.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

The invention claimed is:

1. A rotary atomizer for coating work pieces comprising a rotating bell-shaped plate shaft of a bell-shaped plate extending along an axis of rotation for discharging a spray stream of a coating agent, at least one steering air outlet for discharging steering air for shaping the spray stream, a bearing unit arranged in a housing of said rotary atomizer for a turbine with a turbine wheel for driving said bell-shaped plate, at least one steering air line arranged in said housing opening into said steering air outlet for supplying steering air, wherein steering air line passes through an said bearing unit and through an air space and a second steering air outlet wherein said steering air outlets create two levels of steering air to said bell-shaped plate for shaping the spray stream.

2. A rotary atomizer according to claim 1, wherein said bearing unit comprises at least one steering air inlet in its surface shell and at least one steering air outlet in its end surface facing said bell-shaped plate, said steering air inlet and said steering air outlet of said bearing unit being fluidly connected by a hole in said bearing unit.

3. A rotary atomizer according to claim 2, wherein said hole in the bearing unit runs at an acute angle to said axis of rotation of said bell-shaped plate.

4. A rotary atomizer according to claim 2, wherein said hole in said bearing unit on said side facing said bell-shaped plate extends parallel to said axis of rotation and comprises a needle hole extending from said surface shell of said bearing unit.

5. A rotary atomizer according to claim 1, wherein said steering air line runs at a radial distance from said axis of rotation of said bell-shaped plate, said distance being greater than an outer diameter of said turbine wheel and smaller than an outer diameter of said bearing unit.

6. A rotary atomizer according to claim 1, wherein said steering air line runs essentially without bends at least over a large part of its length.

7. A rotary atomizer according to claim 1, wherein said steering air line extends essentially parallel to said axis of rotation of said bell-shaped plate at least over a large part of its length.

8. A rotary atomizer according to claim 1, wherein said steering air line comprises an essentially constant cross-sectional area at least over a large part of its length.

9. A rotary atomizer according to claim 1, wherein said steering air line comprises an essentially constant cross-sectional shape at least over a large part of its length.

10. A rotary atomizer according to claim 1, wherein said steering air line comprises an obstacle-free interior shape at least over a large part of its length.

11. A rotary atomizer according to claim 1, where said at least two steering air outlets are arranged at a different radial distance from said axis of rotation of said bell-shaped plate.

12. A rotary atomizer according to claim 11, wherein said at least two steering air lines comprise separate steering air lines for guiding the steering air to different of said steering air outlets.

13. A rotary atomizer according to claim 12, comprising a first steering air line is spatially separated from said housing and a second steering air line arranged toward contacting said housing.

14. A turbine for use with a rotary atomizer for coating work pieces comprising;

a housing defining an axis of rotation, a bell-shaped plate rotatable relative to said housing for discharging a spray stream of a coating agent, a bearing unit having a surface shell circumscribing said axis and disposed in said housing and wherein said bearing unit includes a turbine with a turbine wheel to drive said bell-shaped plate, said bearing unit defining a hole exposed to said bell-shaped plate and defining a needle hole extending radially through said surface shell, at least one steering air line passing through said bearing unit and defining at least one steering air inlet for supplying the steering air and at least one steering air outlet for discharging steering air for shaping the spray stream, and said at least one steering air inlet and said at least one steering air outlet being fluidly connected by said hole in said bearing unit extending parallel to said axis of rotation and said needle hole extending from said surface shell of said bearing unit.

15. A rotary atomizer according to claim 14, wherein said hole in the bearing unit runs at an acute angle to said axis of rotation of said bell-shaped plate.

16. A rotary atomizer according to claim 15, wherein said steering air line runs at a radial distance from said axis of rotation of said bell-shaped plate, said distance being greater than an outer diameter of said turbine wheel and smaller than an outer diameter of said bearing unit.

17. A rotary atomizer according to claim 16, wherein said steering air line runs essentially without bends at least over a large part of its length.

18. A rotary atomizer according to claim 17, wherein said steering air line extends essentially parallel to said axis of rotation of said bell-shaped plate at least over a large part of its length.

19. A rotary atomizer according to claim 18, wherein said steering air line comprises an essentially constant cross-sectional area at least over a large part of its length.

20. A rotary atomizer according to claim 19, wherein said steering air line comprises an essentially constant cross-sectional shape at least over a large part of its length.

21. A rotary atomizer according to claim 20, wherein said steering air line comprises an obstacle-free interior shape at least over a large part of its length.

22. A rotary atomizer according to claim 21, comprising at least two steering air outlets arranged at a different radial distance from said axis of rotation of said bell-shaped plate for shaping the spray stream.

23. A rotary atomizer according to claim 22, wherein said at least two steering air lines comprise separate steering air lines for guiding the steering air to different of said steering air outlets.

24. A rotary atomizer according to claim 23, comprising a first steering air line is spatially separated from said housing and a second steering air line arranged toward contacting said housing.

25. A rotary atomizer assembly having a turbine unit for rotating a bell-shaped plate thereby atomizing paint for applying a coating material to work pieces, comprising a housing having said turbine unit disposed therein;

a first air line disposed through said turbine unit for conveying air through an inner steering air outlet; and a second air line defined between said turbine unit and said housing for conveying air through an outer steering air outlet, thereby providing two levels of steering air to said bell-shaped plate.

* * * * *

UNITED STATES PATENT AND TRADEMARK OFFICE

CERTIFICATE OF CORRECTION

PATENT NO. : 7,036,750 B2 
APPLICATION NO. : 10/624586
DATED : May 2, 2006
INVENTOR(S) : Harry Krumma and Michael Baumann It is certified that error appears in the above-identified patent and that said Letters Patent is hereby corrected as shown below:

Column 4, line 58, please delete “an.”

Column 5, line 30, please delete the word “where” and insert --wherein--.

Column 5, line 38, please delete “is.”

Column 5, line 39, please delete the word “toward” and insert --towards and--.

Column 6, line 42, please delete the word “where” and insert --wherein--.

Column 6, line 43, please delete the word “toward” and insert --towards and--.

Signed and Sealed this

Twenty-eighth Day of November, 2006

JON W. DUDAS
*Director of the United States Patent and Trademark Office*